US007762241B2

(12) United States Patent
Childress et al.

(10) Patent No.: US 7,762,241 B2
(45) Date of Patent: Jul. 27, 2010

(54) EVAPORATIVE EMISSION MANAGEMENT FOR VEHICLES

(75) Inventors: Terry Wayne Childress, Clinton Township, MI (US); Jason Eugene Devries, Belleville, MI (US); Mark William Powers, Wolverine Lake, MI (US); Douglas Joseph Mancini, Macedon, NY (US); Eric A. Macke, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 161 days.

(21) Appl. No.: 12/124,691

(22) Filed: May 21, 2008

(65) Prior Publication Data

US 2009/0288645 A1 Nov. 26, 2009

(51) Int. Cl.
*F02M 33/04* (2006.01)
*F02M 33/02* (2006.01)

(52) U.S. Cl. ..... 123/520; 123/519

(58) Field of Classification Search ..... 123/520, 123/519, 518, 516, 198 D, 698; 137/43, 137/587–589, 493; 60/283, 285
See application file for complete search history.

(56) References Cited

U.S. PATENT DOCUMENTS 3,352,294 A * 11/1967 Skarstrom et al. ..... 123/519
3,515,107 A * 6/1970 Joyce ..... 123/520
3,575,152 A 4/1971 Wentworth
3,884,204 A 5/1975 Krautwurst et al.
4,279,233 A * 7/1981 Tobita et al. ..... 123/519
4,790,283 A * 12/1988 Uranishi et al. ..... 123/519
4,872,439 A * 10/1989 Sonoda et al. ..... 123/519
4,894,072 A 1/1990 Turner et al.
5,056,494 A * 10/1991 Kayanuma ..... 123/519
5,111,795 A 5/1992 Thompson
5,165,379 A 11/1992 Thompson
5,456,238 A * 10/1995 Horiuchi et al. ..... 123/520
5,477,836 A * 12/1995 Hyodo et al. ..... 123/519
5,676,116 A * 10/1997 Kim ..... 123/518
5,806,500 A * 9/1998 Fargo et al. ..... 123/520
6,374,811 B1 4/2002 Mancini
6,425,365 B1 7/2002 Peters et al.
6,532,944 B1 3/2003 Leone et al.
6,557,534 B2 5/2003 Robichaux et al.
6,594,562 B2 7/2003 Kaiser et al.
6,668,807 B2 12/2003 Weldon et al.
7,021,296 B2 4/2006 Reddy
7,059,306 B2 6/2006 Reddy
7,614,387 B2 * 11/2009 Wang et al. ..... 123/519

* cited by examiner

*Primary Examiner*—Mahmoud Gimie
(74) *Attorney, Agent, or Firm*—Allan J. Lippa; Brooks Kushman P.C.

(57) ABSTRACT

Evaporative emissions management for a vehicle having a fuel tank and a low-vacuum internal combustion engine, including hybrid electric vehicles, include first and second canisters with the second canister disposed between the first canister and atmosphere. A refueling valve routes fuel vapors from the fuel storage tank through the first canister, and to the second canister when the first canister becomes saturated, during refueling. Other than during refueling, the refueling valve is closed to route fuel vapors around the first canister and directly into the second canister. First and second purge valves are controlled during canister regeneration or purging so air from atmosphere is routed primarily through the second canister to the engine to purge the second canister before the purge valves are operated to route air from atmosphere through both the second and first canisters to purge the first canister.

20 Claims, 2 Drawing Sheets

Figure 1:
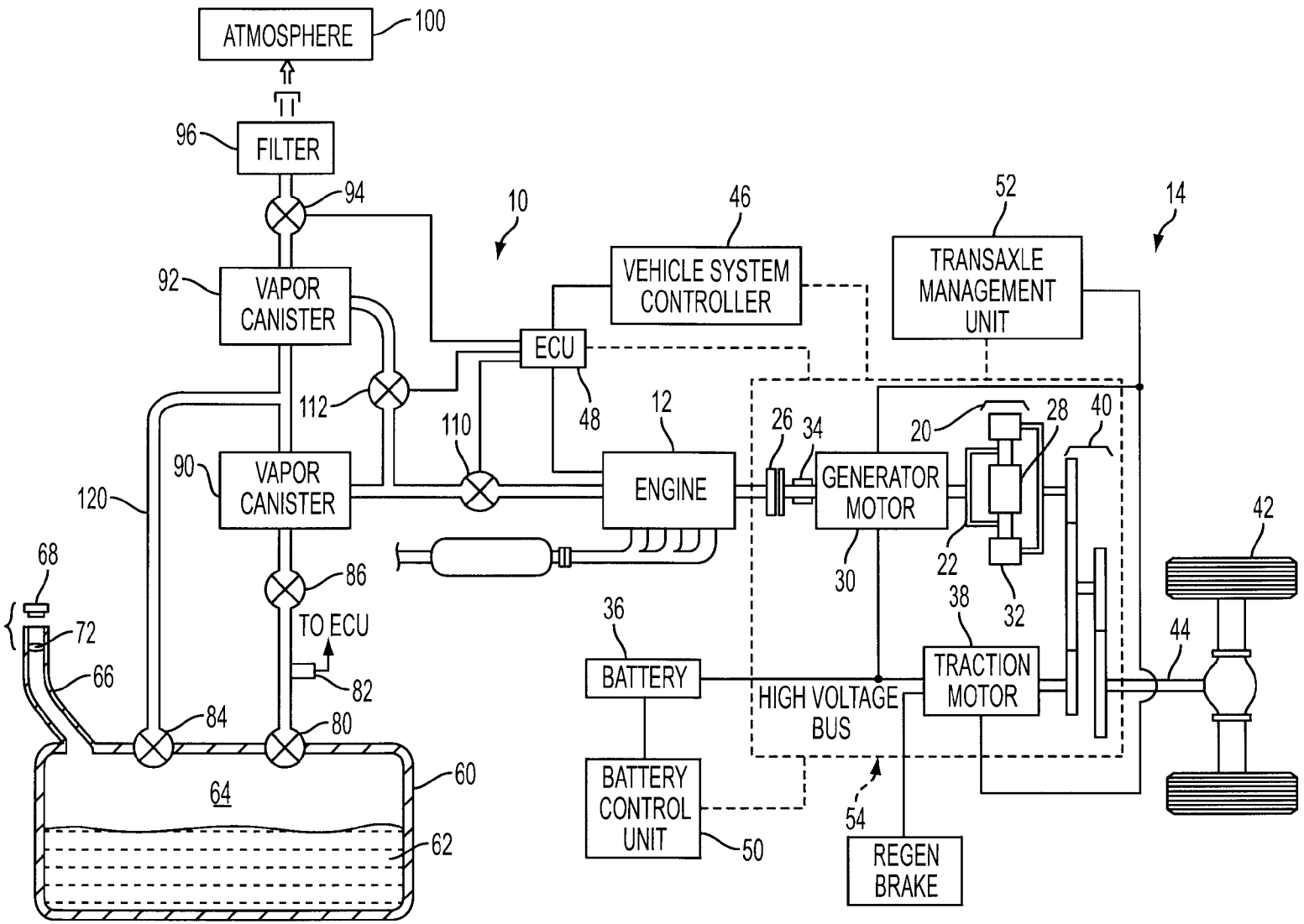

| MODE | VALVE ID A | VALVE ID B | VALVE ID C | VALVE ID D |
|---|---|---|---|---|
| VALVE STATE PURGING ③ - ④ | OPEN | CLOSED | OPEN | OPEN③ THEN CLOSED④ |
| VALVE STATE REFUELING ② | OPEN | OPEN | CLOSED | OPEN |
| VALVE STATE RESTING ① | OPEN | CLOSED | CLOSED | OPEN |
| ENGINE RUNNING MONITOR | CLOSED | CLOSED | OPEN THEN CLOSED | OPEN |
| EONV | CLOSED | CLOSED | CLOSED | OPEN |

EVAPORATIVE EMISSION MANAGEMENT FOR VEHICLES

BACKGROUND

1. Technical Field

The present disclosure relates to systems and methods for controlling evaporative emissions in vehicles having an internal combustion engine that may have limited operating cycles and/or may be operated with low manifold vacuum, including hybrid electric vehicles (HEV's).

2. Background Art

Vehicles having internal combustion engines including hybrid electric vehicles incorporate various strategies for managing fuel vapors that may be generated during refueling or when resting (with the engine off) due to temperature and pressure variations within the fuel tank, for example. Evaporative emission control systems and methods may use one or more canisters that capture and temporarily store fuel vapors to reduce or prevent the vapors from escaping to atmosphere. The canisters are periodically purged of stored fuel vapors during engine operation using vacuum created by a throttle valve in the intake manifold to route the vapors to the engine cylinders for combustion in combination with liquid fuel from the fuel tank. Canister purging cycles are controlled to mange engine performance, evaporative emissions, and exhaust emissions while minimizing any perceptible change in engine/vehicle operation. The length of time required to purge the canister(s) depends on various operating parameters including the amount or level of available vacuum generated within the intake that draws fresh air through the canister(s) to purge the stored fuel vapor. Engine and vehicle operating constraints may also impact the available or acceptable purge rate and thereby impact the time required for a complete purge of the canister(s).

Various engine/vehicle technologies have been developed to improve overall fuel efficiency that impact the control of evaporative emission control systems. One approach is to reduce engine pumping losses by reducing manifold vacuum. This may be accomplished by eliminating the throttle valve and using other airflow control devices, such as in some variable cam timing or variable valve timing applications, for example. Where a throttle valve is employed, operating the engine with the throttle valve position closer to wide open whenever possible also lowers intake manifold vacuum and reduces pumping losses. Representative engine technologies that limit engine operation and/or operate with low manifold vacuum under more operating conditions include variable cam timing, variable valve timing, gasoline turbocharged direct injection, and engines used in hybrid electric vehicles, for example.

Hybrid electric vehicles combine an internal combustion engine in various configurations with an electric motor/generator and one or more batteries to power the vehicle. The internal combustion engine may be used when needed to power the motor/generator to recharge the batteries and/or to power the vehicle in combination with the battery. Most strategies attempt to minimize operation of the internal combustion engine and to operate the engine unthrottled or near wide-open throttle for better fuel efficiency. However, purging or regenerating the vapor storage canister(s) requires running the internal combustion engine to draw the vapors into the engine cylinders and provide combustion of the vapors.

Commonly owned U.S. Pat. No. 6,557,534 discloses a canister purge strategy during idling for a hybrid electric vehicle having a single vapor canister that may selectively increase intake manifold vacuum by electronically controlling the throttle valve to increase the purging rate during a purging cycle. The engine speed is controlled by the electric motor to prevent engine stumbling or stalling otherwise associated with rapid ingestion of the fuel vapor. Commonly owned U.S. Pat. No. 5,111,795 discloses an integrated evaporative emission system with integrated or dedicated primary and refueling canisters connected in parallel to capture fuel vapors. A fluidic controller is used to route the vapors to the canisters with one or more purge valves used to route the vapor to the engine during purging. While suitable for many applications, neither strategy is generally applicable to various types of engines having limited operation and/or low intake manifold vacuum.

SUMMARY

A system and method for managing evaporative emissions of a vehicle having a fuel storage tank and an internal combustion engine include a first canister having a first vapor storage capacity selectively fluidly coupled to the fuel storage tank, a second canister having a second vapor storage capacity fluidly coupled to the first canister and selectively fluidly coupled to atmosphere, and a refueling valve selectively operable during refueling to route fuel vapors from the fuel storage tank through the first canister, and to the second canister when the first canister becomes saturated, during refueling of the fuel storage tank. Other than during refueling, the refueling valve is closed to route fuel vapors around the first canister and directly into the second canister. First and second purge valves are controlled during canister regeneration or purging such that air from atmosphere is routed through the second canister to the engine so that the second canister is purged before purging the first canister.

In one embodiment, a method for managing evaporative emissions from a vehicle having an internal combustion engine and a fuel storage tank with a filler tube and associated removable fuel cap comprises routing fuel vapors from the fuel storage tank through a first vapor storage canister until saturated with fuel vapor and then to a second vapor storage canister coupled to atmosphere while the fuel cap is opened, and routing fuel vapors from the fuel storage tank around the first vapor storage canister to the second vapor storage canister when the fuel cap is closed. The method may also include purging the second vapor storage canister coupled to atmosphere by routing air from atmosphere through the second vapor storage canister to the internal combustion engine to reduce fuel vapor concentration below a corresponding threshold before purging the first vapor storage canister. Purging the first vapor storage canister may comprise routing air from atmosphere through the first and second vapor storage canisters to the internal combustion engine.

The present disclosure includes embodiments having various advantages. For example, systems and methods of the present disclosure combine a (second) vapor storage canister coupled to atmosphere that is appropriately sized to capture diurnal and resting loss vapors with another (first) vapor storage canister selectively coupled in series to provide additional vapor storage capacity during refueling. Use of two or more canisters during refueling facilitates reducing the required size of the canister coupled to atmosphere relative to various prior art strategies. Independent purging control valves are operated to purge the diurnal canister coupled to atmosphere before purging the refueling canister. Independent purging of the diurnal and refueling canisters allows control flexibility to more completely purge the diurnal canister over one or more limited duration engine operating cycles that may occur in hybrid electric vehicles, or to accommodate lower purge rates (and longer purging times) for vehicles having low-vacuum operating strategies.

The above advantages and other advantages and features will be readily apparent from the following detailed description of the preferred embodiments when taken in connection with the accompanying drawings.

DETAILED DESCRIPTION OF THE DRAWINGS

Figures 2, 3:
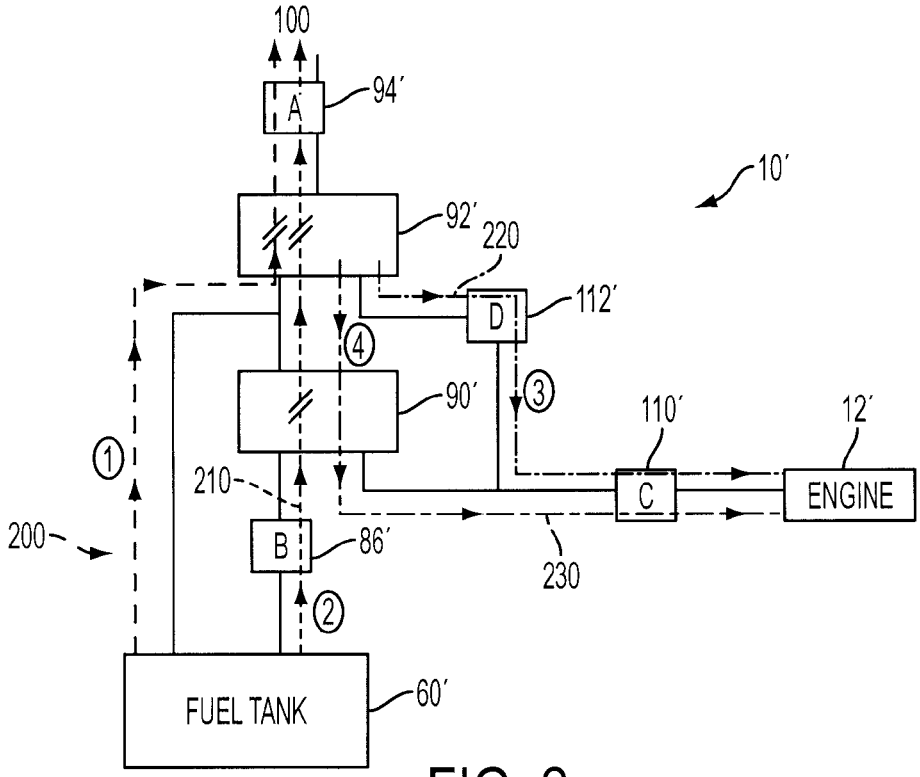

FIG. 1 is a block diagram illustrating a system and method for managing evaporative emissions in a hybrid electric vehicle according to one embodiment of the present disclosure;

FIG. 2 is a block diagram illustrating vapor flow in a representative system and method for managing evaporative emissions for use with various types of low intake manifold internal combustion engines according to embodiments of the present disclosure; and FIG. 3 is a chart illustrating valve open/closed states for a representative embodiment of an evaporative emissions management system or method according to the present disclosure.

DETAILED DESCRIPTION OF EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a vehicle having an internal combustion engine operated with low intake manifold vacuum and/or operated for limited duration operating cycles, which is common in hybrid electric vehicles, for example. The block diagrams of the Figures represent various engine technologies having electronically controlled throttle valves or throttleless intakes that may operate at wide-open throttle or near wide-open throttle to reduce pumping losses.

FIG. 1 is a block diagram illustrating a system and method for managing evaporative emissions in a vehicle with an internal combustion engine with limited duration operating cycles according to one embodiment of the present disclosure. In the embodiment illustrated in FIG. 1, system 10 includes an internal combustion engine 12 associated with a representative hybrid electric vehicle (HEV) 14. The systems and methods for managing evaporative emissions according to the present disclosure are generally independent of the particular engine and vehicle technology. However, the systems and methods for managing evaporative emissions according to the present disclosure are particularly suited for applications, such as an HEV, where the internal combustion engine operates for relatively short durations compared to conventional vehicles and/or operates with low intake manifold vacuum compared to conventional engines. Other engine technologies that operate with low intake manifold vacuum included, but are not limited to, electronically controlled throttle valve or throttle-less engines such as gasoline direct injected engines and engines having variable valve timing or variable cam timing, for example, and may benefit from an evaporative emissions strategy according to the present disclosure.

HEV 14 may be referred to as a parallel/series hybrid electric vehicle or powersplit configuration. Of course, system 10 may be used in various other HEV configurations employing an internal combustion engine 12, such as a series HEV configuration, or parallel HEV configuration, for example. A planetary gear set 20 includes a carrier gear 22 coupled to engine 12 via a one-way clutch 26. Planetary gear set 20 also includes a sun gear 28 coupled to a generator motor 30 and ring gear 32. Generator motor 30 is mechanically coupled to a generator brake 34 and electrically coupled to a battery 36. A traction motor 38 is mechanically linked to ring gear 32 of planetary gear set 20 via a second gear set 40 and is electrically linked to battery 36. Ring gear 32 of planetary gear set 20 and traction motor 38 are mechanically coupled to drive wheels 42 via an output shaft 44.

Planetary gear set 20 splits the output energy from engine 14 into a series path to generator motor 30 and a parallel path to drive wheels 42. Engine speed can be controlled by varying the split to the series path while maintaining the mechanical connection through the parallel path. Traction motor 38 may operate in combination with engine 14 to power drive wheels 42 through second gear set 40. Traction motor 38 may also directly power drive wheels 42 while engine 12 is off using power from battery 36.

Vehicle system controller (VSC) 46 coordinates vehicle control using one or more integrated or discrete system controllers, such as engine control unit (ECU) 48, battery control unit (BCU) 50, and transaxle management unit (TMU) 52 via a communication network 54. In general, each controller uses one or more microprocessors to execute commands based on data stored in volatile and non-volatile computer readable storage media that represent instructions as well as operating and calibration parameters and variables as well known in the art. Control of evaporative emission management system 10 may be implemented by VSC 46 and/or ECU 48, and/or another dedicated or multi-purpose controller depending upon the particular application with a representative control strategy described in detail herein.

Vehicle 14 includes a fuel storage tank 60 for storing liquid fuel 62 that is delivered for combustion within corresponding cylinders of internal combustion engine 12 by a conventional fuel pump and injectors (not shown). Fuel vapor forms in variable space 64 within fuel tank 60 as liquid fuel 62 evaporates due to daily temperature changes (diurnal evaporation), or forms as liquid fuel is introduced through filler tube 66 during refueling. A removable fuel cap 68 is used to provide a fluid seal for filler tube 66. A vacuum relief valve 72 may be incorporated into fuel cap 68 or filler tube 66 to provide a one-way path for air from atmosphere to equalize the pressure within fuel tank 60 as liquid fuel 62 is used by engine 12 while preventing the escape of fuel vapors or liquid fuel from fuel tank 60.

System 10 may include a fuel level vent valve 80, which is a normally open mechanically actuated valve operated by the level of liquid fuel 62 so that valve 80 closes when fuel tank 60 is full or nearly full to trigger the automatic shut-off of the service station pump during refueling. A fuel tank pressure transducer 82 provides a signal to ECU 48 indicative of fuel tank pressure and may be used for various diagnostic functions, as well as determining when to initiate a canister purging cycle as described in greater detail herein. Containment valve 84 is a normally open mechanically actuated valve that closes to keep liquid fuel 62 within fuel tank 60 in the event of a crash resulting in abnormal vehicle orientation. In this embodiment, refueling valve 86 is a normally closed pneumatically actuated vapor blocking valve that operates in response to a pressure difference across the valve. As such, valve 86 operates independently of ECU 48 and opens during refueling of fuel tank 60 or whenever fuel cap 68 is opened or removed from filler tube 66. Various other types of refueling valves may be used depending upon the particular application and implementation.

As also illustrated in FIG. 1, a refueling (first) vapor storage canister 90 having a first vapor storage capacity is selectively fluidly coupled to fuel storage tank 60 via pneumatically operated valve 86. A diurnal (second) vapor storage canister 92 having a second vapor storage capacity is fluidly coupled to first canister 90 and selectively fluidly coupled to atmosphere 100 via a normally open electromagnetically actuated canister vent valve 94, which is controlled by ECU 48. The actual size of each canister 90, 92 may depend upon the particular formulation of the active ingredients used to temporarily store the fuel vapors. Canisters may incorporate various formulations of carbon-based media or other media suitable for absorbing hydrocarbons. In one representative embodiment using similar formulations of a lower absorption rate media, refueling canister 90 has a capacity of between about 0.6 and 1.1 liters (depending on the particular engine/vehicle application) with a corresponding diurnal canister 92 having a capacity of about 1.5 liters. In similar applications using a higher absorption rate formulation, canister 90 has a capacity of between about 0.45 to 0.85 liters and canister 92 has a capacity of about 1.25 liters. Depending upon the particular application and implementation, each of the canisters may have a different media formulation and/or nominal hydrocarbon absorption rate.

In the illustrated embodiments, refueling canister 90 generally has a smaller capacity than diurnal canister 92. However, refueling canister 90 may have the same capacity, or a larger capacity than diurnal canister 92 depending upon the particular application. For example, if the vapor generation rate through line 120 (path 200 of FIG. 2) is significantly reduced, then diurnal canister 92 may be smaller than refueling canister 90. Vapor generation rate can be decreased by lowering the average bulk fuel temperatures, increasing fuel tank pressure, and/or improving the cooling rate of the canisters. Alternatively, one canister may have a higher or lower absorption rate per unit volume, which may also affect the capacity or total volume of each canister in a particular application.

A filter 96 may be disposed between valve 94 and atmosphere 100 to prevent contaminants from entering system 10 from atmosphere 100. A normally closed electromagnetically actuated first purge valve 110 is disposed between first canister 90 and the intake manifold of internal combustion engine 12. A second purge valve 112, which is a normally open electromagnetically actuated valve, is disposed between second canister 92 and internal combustion engine 12. First purge valve 110 and second purge valve 112 are electrically connected to, and controlled by, ECU 48.

FIGS. 2 and 3 illustrate operation of a system and method for managing evaporative emissions according to embodiments of the present disclosure. FIG. 2 is a block diagram illustrating vapor flow paths in a representative system and method for managing evaporative emissions for use with various types of low intake manifold internal combustion engines according to embodiments of the present disclosure. Primed reference numerals (such as 90', for example) indicate components having similar structure and function to components having corresponding unprimed reference numerals (such as 90) and vice versa, unless otherwise noted. FIG. 3 is a chart illustrating valve states of valves "A" (94, 94'), "B" (86, 86'), "C" (110, 110'), and "D" (112, 112') for various operating and diagnostic modes of systems 10, 10'.

Referring now to FIGS. 1-3, during the "resting" mode (also denoted "1" in FIG. 3) with engine 12' off (not combusting fuel) and fuel cap 68 properly installed, a pressure differential is created across refueling valve 86 (B) causing the valve to close and blocking vapor flow from space 64 in fuel tank 60. ECU 48 allows vent valve 94 (A) to remain open to selectively couple canister 92' to atmosphere so that vapors from fuel tank 60' flow into, and are stored by diurnal canister 92' as indicated by flow path 200 (also denoted "1" in FIGS. 2 and 3). ECU 48 also controls first and second purge valves 110' (C) and 112'(D) allowing these valves to remain closed during the resting mode.

Refueling valve 86 (86') is selectively operable by opening of fuel cap 68, which creates a pressure differential across the valve causing it to open and system 10' enters the "Refueling" mode ("2") with vapors traveling from fuel tank 60' along flow path 210 into refueling canister 90'. If or when refueling canister 90' becomes saturated, vapors will continue along flow path 210 into diurnal canister 92'. As shown in the chart of FIG. 3, during the refueling mode, ECU 48 allows vent valve 94'(A) and purge valve 112' (D) to remain open while closing purge valve 110 (110'), which prevents vapors from traveling to the intake manifold of engine 12'. Thus, during the refueling mode, refueling valve 86' operates in response to opening of the fuel cap to route fuel vapors from fuel tank 60' through a first canister 90', and to a second canister 92' when the first canister becomes saturated with fuel vapor. During other modes with the fuel cap properly secured, refueling valve 86' is closed causing fuel vapors from fuel tank 60' to travel around first canister 90' and directly into second canister 92'.

The first and second canisters can be substantially independently regenerated or purged of stored vapors through corresponding control of valves 94', 110', and 112'. According to the present disclosure, the relatively larger diurnal canister 92' exposed to atmosphere 100 is purged before the relatively smaller canister 90' to reduce or eliminate the escape of vapors from canister 92' to atmosphere. When ECU 48 determines that canister regeneration or purging is desirable and begins the purging mode ("3"), first and second purge valves 110' (C), 112'(D) are opened along with vent valve 94' (A) so that air from atmosphere travels primarily along flow path 220 through canister 92' moving fuel vapors into the intake manifold of engine 12' for combustion along with liquid fuel injected by corresponding fuel injectors (not shown). Those of ordinary skill in the art will recognize that, with both purge valves 110', 112' open, some small amount of flow may pass through diurnal canister 90' along flow path 230. However, the higher resistance associated with flow through the additional absorption media of canister 90' has a self-limiting effect on the flow rate so that canister 92' has a higher flow rate and is purged or regenerated before canister 90'.

After ECU 48 determines that the fuel vapor concentration of flow from canister 92' is below a corresponding threshold, which may be a programmable threshold, second purge valve 112' is closed so that air from atmosphere 100 flows through both diurnal canister 92' and refueling canister 90' along primary flow path 230 to increase the purging rate of refueling canister 90' as designated by the second phase ("4") of the purging mode in FIG. 3. During this phase of a purging event, air from atmosphere flowing through canister 92' may further lower the concentration of stored fuel (hydrocarbon) vapors in canister 92', although at a substantially lower rate than the purging rate associated with the same flow through canister 90', which generally has a higher concentration of fuel vapors because of little or no airflow through canister 90' during the first phase ("3") of the purging event.

A first diagnostic mode ("Engine Running Monitor") used to detect vacuum leaks may be entered periodically or in response to a particular operating or ambient condition as determined by ECU 48. During the "Engine Running Monitor" mode, vent valve "A" is closed and purge valve "C" is first opened to create a vacuum within system 10' and then closed while monitoring the reading from fuel tank pressure transducer 82 and/or other sensors to detect any leaks in within the system. Similarly, a second diagnostic mode ("EONV") used to detect smaller vacuum leaks than the first diagnostic mode may be entered periodically or in response to a particular operating or ambient condition as determined by ECU 48. The EONV ("Engine Off Natural)Vacuum") mode is typically entered when the ignition key for engine 12' is turned to the off position. ECU 48 then executes instructions to close valves 94', 110', and 112' with valve 86' being closed by a substantially equal pressure across the valve with the fuel cap secured. ECU 48 then monitors the system pressure/vacuum using one or more sensors, such as fuel tank pressure transducer 82 to detect any system leaks.

As illustrated in FIGS. 1-3, ECU 48 communicates with at least the first purge valve 110, second purge valve 112, and vent valve 94 and selectively operates the valves to purge second vapor storage canister 92 prior to operating the valves to purge the first vapor storage canister 90, with refueling valve 86 pneumatically actuated independently of ECU 48 by a pressure differential across the refueling valve. In the previously described embodiments, ECU 48 includes instructions for selectively operating purge valves 110', 112' to route air from atmosphere primarily through the vapor canister 92' exposed to atmosphere until detected fuel vapor entering the intake manifold of engine 12' is less than a corresponding threshold. ECU 48 may also include instructions for selectively operating the first and second purge valves 110, 112, to route air from atmosphere through both the first and second vapor storage canisters 90, 92 to internal combustion engine 12 by closing valve 112 after fuel vapor concentration drops below the threshold.

Similarly, as illustrated in FIGS. 1-3, a method for managing evaporative emissions from a vehicle 14 having an internal combustion engine 12 and a fuel storage tank 60 with a filler tube 66 and associated removable fuel cap 68 according to the present disclosure includes routing fuel vapors from the fuel storage tank 60 through a first vapor storage canister 90 until saturated with fuel vapor and then to a second vapor storage canister 92 coupled to atmosphere 100 while the fuel cap 68 is opened, and routing fuel vapors from the fuel storage tank 60 around the first vapor storage canister 90 to the second vapor storage canister 92 when the fuel cap 68 is secured and sealed. The method may also include purging the second vapor storage canister 92 coupled to atmosphere 100 by routing air from atmosphere 100 through the second vapor storage canister 92 to the internal combustion engine 12 to reduce fuel vapor concentration below a corresponding threshold before routing substantially all air from atmosphere through both canisters 90, 92 to purge the first vapor storage canister 90 of stored fuel vapors.

Embodiments of systems and methods for managing evaporative emissions according to the present disclosure have various advantages. For example, the systems and methods of the present disclosure combine a larger diurnal and resting vapor storage canister coupled to atmosphere with a relatively smaller refueling vapor storage canister selectively coupled in series to provide additional vapor storage capacity during refueling. Use of two or more canisters only during refueling facilitates reducing the required size of the canister coupled to atmosphere and allows substantially independent purging of the canisters so that a smaller diurnal canister (relative to various prior art strategies) may be more completely purged before purging the refueling canister, which only needs purging prior to a subsequent refueling event. Independent purging control valves direct primary airflow to purge the diurnal canister coupled to atmosphere before redirecting airflow to purge the refueling canister. Purging may be controlled to more completely purge the diurnal canister over one or more limited duration engine operating cycles that may occur in hybrid electric vehicles, or to accommodate lower purge rates (and longer purging times) for vehicles having low-vacuum operating strategies.

While the best mode has been described in detail, those familiar with the art will recognize various alternative designs and embodiments within the scope of the following claims. While various embodiments may have been described as providing advantages or being preferred over other embodiments and/or prior art strategies with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed:

1. A system comprising:

a first vapor canister selectively coupled to a fuel tank;

a second vapor canister coupled to the first canister and selectively coupled to atmosphere; and a refueling valve operable by fuel cap removal to route vapors through the first canister and to the second canister upon first canister saturation, and causing fuel tank vapors to travel around the first canister and directly into the second canister when the fuel cap is secured.

2. The system of claim 1 further comprising a first purge valve disposed between the first canister and an associated internal combustion engine and selectively operable to route air from atmosphere through the second canister and then through the first canister to the internal combustion engine during purging.

3. The system of claim 2 further comprising a second purge valve disposed between the second canister and the internal combustion engine and selectively operable to route air from atmosphere around the first canister and through the second canister to the internal combustion engine during purging.

4. The system of claim 3 further comprising a microprocessor-based controller in communication with the second purge valve, the controller including instructions for opening the second purge valve during purging until fuel vapor from the second canister is less than a corresponding threshold and closing the second purge valve otherwise.

5. The system of claim 1 further comprising a vent valve disposed between the second canister and atmosphere and selectively operable to couple the second canister to atmosphere.

6. The system of claim 1 wherein the second canister is fluidly coupled to the fuel storage tank.

7. The system of claim 1 further comprising:

a first purge valve disposed between the first canister and an associated internal combustion engine;

a second purge valve disposed between the second canister and the internal combustion engine; and a controller in communication with the first and second purge valves, the controller selectively opening at least the second purge valve to route air from atmosphere through the second canister to the internal combustion engine during a first portion of a purging cycle and closing the second purge valve to route air from atmosphere through the first and second canisters to the internal combustion engine during a second portion of the purging cycle.

8. The system of claim 1 wherein the refueling valve comprises a pneumatic valve operable in response to a differential pressure associated with opening of the fuel cap from a filler tube of the fuel tank.

9. The system of claim 1 wherein the second vapor canister has a vapor storage capacity of at least 1.3 times larger than the vapor storage capacity of the first vapor canister.

10. An evaporative emissions management system for a vehicle having a fuel storage tank and an internal combustion engine, the system comprising:

a first vapor storage canister having a first vapor storage capacity fluidly coupled to the fuel storage tank;

a second vapor storage canister having a second vapor storage capacity fluidly coupled to the first canister, the fuel storage tank, and atmosphere;

a refueling valve disposed between the fuel storage tank and the first canister selectively operable to allow fuel vapors to flow from the fuel storage tank through the first canister;

a first purge valve disposed between the first vapor storage canister and the internal combustion engine;

a second purge valve disposed between the second vapor storage canister and the internal combustion engine;

a vent valve disposed between the second vapor storage canister and atmosphere; and a controller in communication with at least the first and second purge valves and the vent valve, the controller selectively operating the first and second purge valves and the vent valve to purge the second vapor storage canister prior to operating the first and second purge valves and the vent valve to purge the first vapor storage canister.

11. The system of claim 10 wherein the refueling valve comprises a pneumatically actuated valve operated independently of the controller by a pressure differential across the refueling valve.

12. The system of claim 10 wherein the controller includes instructions for selectively operating the first and second purge valves to route air from atmosphere substantially entirely through the second vapor storage canister to the internal combustion engine until detected fuel vapor is less than a corresponding threshold.

13. The system of claim 12 wherein the controller includes instructions for selectively operating the first and second purge valves to route air from atmosphere through both the first and second vapor storage canisters to the internal combustion engine after detected fuel vapor from the second vapor storage canister is less than the threshold.

14. The system of claim 13 wherein the controller includes instructions for closing the second purge valve after detected fuel vapor from the second vapor storage canister is less than the threshold.

15. The system of claim 10 wherein the refueling valve opens when a fuel cap sealing a filler tube of the fuel storage tank is opened to allow fuel vapors to flow into the first vapor storage canister.

16. The system of claim 15 wherein the vent valve is open during refueling to allow vapors to flow from the first vapor storage canister to the second vapor storage canister after the first vapor storage canister becomes saturated with fuel vapor.

17. A method for managing evaporative emissions comprising:

routing fuel vapors from a fuel storage tank through a first vapor storage canister until saturated with fuel vapor and then to a second vapor storage canister coupled to atmosphere while a fuel cap is opened; and routing fuel vapors from the fuel storage tank around the first vapor storage canister to the second vapor storage canister when the fuel cap is closed.

18. The method of claim 17 further comprising:

purging the second vapor storage canister coupled to atmosphere by routing air from atmosphere through the second vapor storage canister to the internal combustion engine to reduce fuel vapor concentration below a corresponding threshold before purging the first vapor storage canister.

19. The method of claim 18 wherein purging the first vapor storage canister comprises routing air from atmosphere through the first and second vapor storage canisters to the internal combustion engine.

20. The method of claim 17 wherein the first vapor storage canister has a smaller vapor storage capacity than the second vapor storage canister and wherein the method includes purging the smaller capacity canister after purging the larger capacity canister.

* * * * *

UNITED STATES PATENT AND TRADEMARK OFFICE

CERTIFICATE OF CORRECTION

PATENT NO. : 7,762,241 B2
APPLICATION NO. : 12/124691
DATED : July 27, 2010
INVENTOR(S) : Terry Wayne Childress It is certified that error appears in the above-identified patent and that said Letters Patent is hereby corrected as shown below:

On the title page, item [75]

Delete the name of the third inventor "Mark William Powers"

and insert therefor -- Mark William Peters --.

Signed and Sealed this
Tenth Day of May, 2011

David J. Kappos

David J. Kappos
*Director of the United States Patent and Trademark Office*